US005435830A

United States Patent [19]

Senda et al.

[11] Patent Number: 5,435,830

[45] Date of Patent: Jul. 25, 1995

[54] METHOD OF PRODUCING FINE POWDERS

[75] Inventors: Atsuo Senda; Takuji Nakagawa; Yoshihiko Takano, all of Nagaokakyo, Japan

[73] Assignee: Murata Manufacturing Co., Ltd., Kyoto, Japan

[21] Appl. No.: 257,268

[22] Filed: Jun. 9, 1994

Related U.S. Application Data

[63] Continuation-in-part of Ser. No. 949,046, Sep. 21, 1992, abandoned.

[30] Foreign Application Priority Data

Sep. 20, 1991 [JP] Japan ..... 3-270162

[51] Int. Cl.[6] ..... B22F 9/24

[52] U.S. Cl. ..... 75/370; 75/371; 423/510

[58] Field of Search ..... 75/343, 347, 348, 351, 75/370, 371; 423/510, 566.2

[56] References Cited

U.S. PATENT DOCUMENTS

| | | | |
|---|---|---|---|
| 4,217,152 | 8/1980 | Aonuma et al. | 75/347 |
| 4,445,931 | 5/1984 | Worthington | 75/343 |
| 4,803,291 | 2/1984 | Rousset et al. | 75/348 |

*Primary Examiner*—George Wyszomierski

*Attorney, Agent, or Firm*—Ostrolenk, Faber, Gerb & Soffen

[57] ABSTRACT

First, an aqueous solution of water soluble compounds or an aqueous solution of water soluble complexes, which is a salt of elements belonging to the 6A, 7A, 1B, 2B, 3B, 4B, 5B, 6B, or 8 group in a periodic table are prepared. The pH of the aqueous solution is adjusted and titanium trichloride is added thereto. The aqueous solution provided with titanium trichloride is stirred at temperature below the boiling point of the solution under atmospheric pressure or under high pressure. Then, by the reducing action of the titanium trichloride, a fine titanium-free powder selected from the group consisting of a metal powder, an alloy powder containing two or more of metals and non-metals, or a compound powder containing two or more of metals and non-metals is obtained.

18 Claims, No Drawings

METHOD OF PRODUCING FINE POWDERS

This is a continuation-in-part of application Ser. No. 07/949,046 filed Sep. 21, 1992, now abandoned.

BACKGROUND OF THE INVENTION

1. Field of the Invention

The present invention relates to a method of producing fine powders, such as a Sn powder, Pb powder, Zn powder, Ni powder, In powder, Sb powder, Cd powder, As powder, Pb—Sb—Sn powder, Pb—Sb—As powder, Re powder, Mo powder, Se powder, Te powder, Cu powder, CdS powder etc.

Sn powder is used as a soldering material or a sensor material. Pb powder is used as a soldering material, a pigment material for paints, a molding material, a sintering material or a cell material. Zn powder is used as a rust-proof material or a cell material. Ni powder is used as an electrode paste material, or an electrode material of a battery and a fuel cell. In powder is used as a soldering material, a sintering material or a dental material. Sb powder is used as a resistive material or a sensor material. Cd powder is used as a catalyst, a powder metallurgy material, in preparation of various ceramic materials or a Ni—Cd battery material. As powder is used as a sensor material. Pb—Sb—Sn powder and Pb—Sb—As powder are used as a cell material. Re powder is used as a filament material or a catalyst. Mo powder is used as a powder metallurgy material or an electron tube material. Se powder is used as an optical semiconductor or a catalyst. CdS powder is used as a solar cell material.

2. Description of the Prior Art

As conventional methods of producing fine powders, a mechanical pulverizing method, an electrolytic method, a spraying method, a volatilization cohesion method or a reduction method are employed.

As mechanical pulverizing methods, a stamp mill method, a ball-mill method and a whirl mill method are used. As electrolytic methods a wet electrolytic method and a dry electrolytic method are used. Furthermore, as spraying methods, a gas spraying method and a water spraying method are used.

The volatilization cohesion method is used in producing the Zn powder. As reduction methods, there are a high temperature reduction method and a salt solution reduction method. The high temperature reduction method is a method for reducing metal compounds with a reducing gas at high temperatures. As the salt reduction method, there are such methods as introducing the metal powder into a metal salt solution to obtain the fine powder by displacement deposition, a reduction method by hydrazine and the like and a reduction method by sodium hypophosphite and DMAB.

In the mechanical pulverizing method, a resultant powder is scaly with a low bulk density. There is also a possibility of mingling of impurities due to wear of a pulverizer and other causes. Moreover, the powder is susceptive to oxidation while the metal and alloy are pulverized. This method is also liable for a cause of dust pollution.

In the electrolytic method, the cost of plant and equipment is apt to increase, and besides, the powder is susceptive to oxidation.

In the spraying method, a grain diameter of the powder is tens of micron and the cost of plant and equipment is high.

The volatilization cohesion method, is limited to production of metal powders having a high vapor pressure such as Zn.

In the high temperature reduction method, the grain diameter of the resultant powder is large and impurities are apt to mingle.

In a displacement deposition method, the metal powder added for effecting displacement deposition is expensive and there is a possibility of impurities to mingle. Moreover, there is inconvenience in handling for depositing the powder.

In a method of precipitating the powder by using such reducing agents as hydrazine, sodium hypophosphite, DMAB and so on, the metals to be reduced are limited and there is a possibility that phosphorus and boron may mingle into the resultant powder as impurities.

SUMMARY OF THE INVENTION

It is, therefore, a primary object of the present invention to provide a method of producing titanium-free fine powders, capable of producing the fine powders of high purity and reduced grain diameter simply and safely without pollution and at low cost.

The present invention is directed to a method of producing fine powders including a step of preparing an aqueous solution of water soluble compounds or an aqueous solution of water soluble complexes, which are salts of elements belonging to the 6A, 7A, 1B, 2B 3B, 4B, 5B, 6B, or 8 group in a periodic table, and a step of producing a fine powder selected from the group consisting of a metal powder, an alloy powder containing two or more of metals and non-metals, and a compound powder containing two or more of metals and non-metals, by adding titanium trichloride to the aqueous solution and using the reducing action of the titanium trichloride.

In the present invention, as elements, Mo belongs to the 6A group, Re belongs to the 7a group, Cu, Ag and Au belong to the 1B group, Zn and Cd belong to the 2B group, In belongs to the 3B group, Sn and Pb belong to the 4B group, Sb, As and Bi belong to the 5B group, Te, Se and S belong to the 6B group, and Ni, Ru, Rh, Pd, Pt, Os and Ir belong to the 8 group in a periodic table, and production of any of these elements or mixtures thereof is included within the scope of the invention.

The metal and non-metal compound or the complex is reduced by titanium trichloride.

According to the present invention, the high purity fine powders having a reduced grain diameter can be produced safely and simply. Besides, the fine powders can be produced without dust pollution at low cost.

The above and other objects, features, aspects and advantages of the present invention will be more apparent from the following detailed description of the embodiments.

DESCRIPTION OF THE PREFERRED EMBODIMENTS

Embodiments of the present invention are explained as follows. In the embodiments, fine powders are produced under the condition that the aqueous solution is below the boiling point of the solution. Furthermore, in the embodiments, the reaction between the aqueous solution and the titanium trichloride takes place under atmospheric pressure or under high pressure.

Embodiment 1

First, $PbCl_2$ was prepared. To the 0.03 mol/L of $PbCl_2$, 0.04 mol/L of ethylenediamine-tetraacetic acid (EDTA) and 0.10 mol/L of citric acid as organic complexing agents were added, and the pH was adjusted to 10 to obtain a mixed aqueous solution. To the mixed aqueous solution, 0.03mol/L of $TiCl_3$ was added as a reducing agent, and the mixture was stirred at 60° C. for about 10 minutes. In such a manner a black precipitate of reduced Pb powder was obtained. The Pb powder precipitate was taken out after being dehydrated by alcohol and dried.

The grain diameter of the resultant Pb powder was 0.4 to 0.5 μm and a uniform fine powder was obtained, compared with the powder obtained in the mechanical pulverizing method and spraying method generally used in producing the Pb powder.

Embodiment 2

First, $SbCl_3$ was prepared. To the 0.03 mol/L of $SbCl_3$, 0.04 mol/L of EDTA and 0.20 mol/L of citric acid were added to obtain an aqueous solution. To the aqueous solution, 28% aqueous ammonia was added and the pH was adjusted to 10 to obtain a mixed aqueous solution. To the mixed aqueous solution, 0.03 mol/L of $TiCl_3$ was added as a reducing agent, and stirred at 60° C. for about 10 minutes. In such a manner, a silver white branch shaped Sb powder having a grain size of 0.5 μm was obtained.

Embodiment 3

First, $InCl_3$ was prepared. To the 0.04 mol/L of $InCl_3$, 0.10 mol/L of nitrilotriacetate (NTA) and 0.30 mol/L of citric acid as organic complexing agents were added to obtain an aqueous solution. To the aqueous solution, 28% aqueous ammonia was added and the pH was adjusted to 10 to obtain a mixed aqueous solution. To the mixed aqueous solution, 0.04 mol/L of $TiCl_3$ was added as a reducing agent, and stirred at 60° C. for about 10 minutes. In such a manner, a silver white In powder having a grain size of 0.8 μm was obtained.

Embodiment 4

First $CdCl_2$ was prepared. To the 0.04 mol/L of $CdCl_2$, 0.04 mol/L of EDTA.2Na and 0.10 mol/L of citric acid were added to obtain an aqueous solution. To the aqueous solution, 28% aqueous ammonia was added to adjust the pH to 10. To the aqueous solution whose pH was adjusted, 0.04 mol/L of $TiCl_3$ was added as a reducing agent, and stirred at 80° C. for about 10 minutes. In such a manner, a silver white Cd powder having a grain size of 0.5 μm was obtained.

Embodiment 5

First, $NiCl_2$ was prepared. To the 0.04 mol/L of $NiCl_2$, 0.10 mol/L of NTA and 0.10 mol/L of sodium tartrate were added to obtain an aqueous solution. To the aqueous solution, 28% aqueous ammonia was added and the pH was adjusted to 10 to obtain a mixed aqueous solution. To the mixed aqueous solution, 0.04 mol/L of $TiCl_3$ was added as a reducing agent, and stirred at 80° C. for about 10 minutes. In such a manner, a black Ni powder having a grain size of 0.8 μm was obtained.

Embodiment 6

First, $SnCl_2$ and $PbCl_2$ were prepared. To the 0.04 mol/L of $SnCl_2$ and 0.02 mol/L of $PbCl_2$, 0.08 mol/L of EDTA, 0.10 mol/L of NTA and 0.30 mol/L of tartaric acid were added to obtain an aqueous solution. To the aqueous solution, 28% aqueous ammonia was added to adjust the pH to 10. To the aqueous solution whose pH was adjusted, 0.04 mol/L of $TiCl_3$ was added as a reducing agent, and stirred at 80° C. for about 15 minutes. In such a manner, a black Sn-Pb powder having a grain size of 0.1 μm was obtained.

Embodiment 7

First, $ReCl_2$ was prepared. To the 0.04 mol/L of $ReCl_2$, 0.04 mol/L of EDTA.2Na and 0.30 mol/L of sodium tartrate were added to obtain an aqueous solution. To the aqueous solution, 28% aqueous ammonia was added to adjust the pH to 10. To the aqueous solution whose pH was adjusted, 0.04 mol/L of $TiCl_3$ was added as a reducing agent, and stirred at 60° C. for about 10 minutes. In such a manner, a dark gray Re powder having a grain size of 1.0 μm was obtained.

Embodiment 8

First, $NaMoO_4$ was prepared. To the 0.04 mol/L of $NaMoO_4$, 0.08 mol/L of urea and 0.20 mol/L of sodium citrate were added to obtain an aqueous solution. To the aqueous solution, 28% aqueous ammonia was added to adjust the pH to 10. To the aqueous solution whose pH was adjusted, 0.04 mol/L of $TiCl_3$ was added as a reducing agent, and stirred at 80° C. for about 10 minutes. In such a manner, a grayish black Mo powder having a grain size of 0.8 μm was obtained.

Embodiment 9

First, $SeCl_4$ was prepared. To the 0.04 mol/L of $SeCl_4$, 0.04 mol/L of EDTA.2Na and 0.20 mol/L of sodium citrate were added to obtain an aqueous solution. To the aqueous solution, 28% aqueous ammonia was added and the pH was adjusted to 10 to obtain a mixed aqueous solution. To the mixed aqueous solution, 0.04 mol/L of $TiCl_3$ was added as a reducing agent, and stirred at 80° C. for about 10 minutes. In such a manner, a dark red Se powder having a grain size of 0.8 μm was obtained.

Embodiment 10

First, $TeCl_2$ was prepared. To the 0.04 mol/L of $TeCl_2$, 0.04 mol/L of EDTA and 0.20 mol/L of citric acid were added to obtain an aqueous solution. To the aqueous solution, 28% aqueous ammonia was added and the pH was adjusted to 10 to obtain a mixed aqueous solution. To the mixed aqueous solution, 0.04 mol/L of $TiCl_3$ was added as a reducing agent, and stirred at 80° C. for about 10 minutes. In such a manner, a black Te powder having a grain size of 0.8 μm was obtained.

Embodiment 11

First, $CuCl_2$ was prepared. To the 0.04 mol/L of $CuCl_2$, 0.06 mol/L of EDTA and 0.20 mol/L of citric acid were added to obtain an aqueous solution. To the aqueous solution, 28% aqueous ammonia was added and the pH was adjusted to 10 to obtain a mixed aqueous solution. To the mixed aqueous solution, 0.04 mol/L of $TiCl_3$ was added as a reducing agent, and stirred at 80° C. for about 10 minutes. In such a manner, a red Cu powder having a grain size of 0.65 μm was obtained.

Embodiment 12

First, $CdCl_2$ and $Na_2S_2O_3$ were prepared. To the 0.08 mol/L of $CdCl_2$ and 0.04 mol/L of $Na_2S_2O_3$, 0.34 mol/L of citric acid, 0.08 mol/L of EDTA and 0.20 mol/L of NTA were added to obtain an mixed aqueous solution. To the mixed aqueous solution, 0.04 mol/L of $TiCl_3$ was added as a reducing agent, and 28% aqueous ammonia was added to adjust the pH to 10. The mixed aqueous solution was stirred at 80° C. for about 30 minutes. In such a manner, a yellow CdS powder having a grain size of 0.8 μm was obtained. By the similar method, InSb alloy powder which is a compound semiconductor can be obtained.

As such, when a production method of the present invention is used, high purity fine powders having a reduced grain diameter can be obtained safely and simply. Besides, dust pollution, such as that which results from a mechanical pulverizing method, can be prevented and the fine powders can be produced at low cost.

While the present invention has been particularly described and shown, it is to be understood that such description is used as an example rather than limitation, and the spirit and scope of the present invention is determined solely by the terms of the appended claims.

What is claimed:

1. A method of producing a fine titanium-free powder of an element selected from the group consisting of Mo, Re, Cu, Ag, Au, Zn, Cd, In, Sn, Pb, Sb, As, Bi, Te, Se, S, Ni, Ru, Rh, Pd, Pt, Os, Ir and mixtures thereof which comprises preparing a reaction mixture by combining a reducing amount of titanium trichloride with an aqueous solution of a water soluble compound or complex of said element at a temperature below the boiling point of the aqueous solution, and thereafter recovering the titanium-free fine powder produced by the reducing action of the titanium trichloride from the reaction mixture.

2. A method of producing a fine powder in accordance with claim 1, additionally comprising the step of preparing said aqueous solution by combining titanium trichloride and water.

3. A method of producing a fine powder in accordance with claim 2, in which the aqueous solution is of a water soluble complex of said element.

4. A method of producing a fine powder in accordance with claim 2, in which the temperature of the aqueous solution is 60° to 80° C.

5. A method of producing a fine powder in accordance with claim 2, in which the element is lead.

6. A method of producing a fine powder in accordance with claim 2, in which the element is antimony.

7. A method of producing a fine powder in accordance with claim 2, in which the element is iridium.

8. A method of producing a fine powder in accordance with claim 2, in which the element is cadmium.

9. A method of producing a fine powder in accordance with claim 2, in which the element is nickel.

10. A method of producing a fine powder in accordance with claim 2, in which the element is a mixture of tin and lead.

11. A method of producing a fine powder in accordance with claim 2, in which the element is rhenium.

12. A method of producing a fine powder in accordance with claim 2, in which the element is molybdenum.

13. A method of producing a fine powder in accordance with claim 2, in which the element is selenium.

14. A method of producing a fine powder in accordance with claim 2, in which the element is tellurium.

15. A method of producing a fine powder in accordance with claim 2, in which the element is copper.

16. A method of producing a fine powder in accordance with claim 2, in which the element is a mixture of cadmium and sulfur.

17. A method of producing a fine powder in accordance with claim 2, in which the element is a mixture of indium and antimony.

18. A method of producing a fine powder in accordance with claim 1, wherein a reaction between the aqueous solution and the titanium trichloride takes place under atmospheric pressure or under high pressure.

* * * * *